US005749291A

United States Patent [19]

Nast et al.

[11] Patent Number: 5,749,291

[45] Date of Patent: May 12, 1998

[54] SYSTEM FOR SETTING DATE WHEELS IN A POSTAGE METER

[75] Inventors: Kurt Nast, Bern; Erwin Berger, Thörishaus; Stefan Etter, Oberhofen; Christian Moy, Grossaffoltern; Martin Müller, Langenthal, all of Switzerland

[73] Assignee: Ascom Hasler Mailing Systems AG, Bern, Switzerland

[21] Appl. No.: 421,902

[22] Filed: Apr. 14, 1995

[51] Int. Cl.[6] ..... B41L 47/46

[52] U.S. Cl. ..... 101/91; 101/484

[58] Field of Search ..... 101/91, 99, 110, 101/484; 235/101, 375, 377; 346/80, 81, 20; 364/145, 464.02

[56] References Cited

U.S. PATENT DOCUMENTS

| | | | |
|---|---|---|---|
| 3,869,986 | 3/1975 | Hubbard | 101/91 |
| 4,060,720 | 11/1977 | Check, Jr. | 235/307 |
| 4,114,533 | 9/1978 | Kittredge | 101/99 |
| 4,283,721 | 8/1981 | Eckert et al. | 340/680 |
| 4,347,506 | 8/1982 | Duwel et al. | 340/679 |
| 4,516,014 | 5/1985 | Eckert | 235/101 |
| 4,520,725 | 6/1985 | Haug | 101/91 |
| 4,635,204 | 1/1987 | Jones et al. | 364/464 |
| 4,639,581 | 1/1987 | Berger et al. | 235/101 |
| 4,649,489 | 3/1987 | Denzin | 364/464 |
| 4,852,482 | 8/1989 | Storace | 101/110 |
| 5,154,118 | 10/1992 | Doery et al. | 101/91 |
| 5,197,042 | 3/1993 | Brookner et al. | 368/10 |
| 5,301,116 | 4/1994 | Grünig | 364/464.02 |
| 5,452,654 | 9/1995 | Connell et al. | 101/91 |

FOREIGN PATENT DOCUMENTS

| | | |
|---|---|---|
| 418705 | 2/1967 | Switzerland . |
| 0062376A1 | 10/1992 | Switzerland . |
| WO 87/03983 | 7/1987 | WIPO . |

*Primary Examiner*—Ren Yan
*Attorney, Agent, or Firm*—Oppedahl & Larson

[57] ABSTRACT

A date-setting method for use in a postage meter having date wheels includes the steps of setting the date wheels, printing a date on a mail piece, requesting an input indicating whether the date printed on the mail piece is correct, receiving a response in the negative, receiving information indicative of the date printed on the mail piece, resetting the date wheels, logging a record indicative of the negative response and the resetting action, printing another date on a mail piece, requesting an input indicating whether the date printed on the mail piece is correct, receiving a response in the negative, receiving information indicative of the date printed on the mail piece, resetting the date wheels, logging another record indicative of the negative response and the resetting action; and annunciating the records indicative of negative responses. Another date-setting method for use in a postage meter having date wheels capable of printing a date on a mail piece includes the steps of setting at least one date wheel, waiting until after the first time that postage has been printed on a mail piece subsequent to the setting of a date wheel, and thereafter, requesting an input indicating whether the date printed on the mail piece is correct.

4 Claims, 7 Drawing Sheets

| | |
|---|---|
| 1 | 0 |
| 2 | 1 |
| 3 | 2 |
| ~~0~~ | 3 |
| 1 | 4 |
| 2 | 5 |
| 3 | 6 |
| ~~0~~ | 7 |
| 1 | 8 |
| 2 | 9 |
| 3 | — |
| ~~0~~ | ~~0~~ |

FIG. 11a
PRIOR ART

| | |
|---|---|
| 1 | 0 |
| 2 | 1 |
| 3 | 2 |
| 0 | 3 |
| 1 | 4 |
| 2 | 5 |
| 3 | 6 |
| 0 | 7 |
| 1 | 8 |
| 2 | 9 |
| 3 | 9 |
| 0 | 0 |

FIG. 11b

SYSTEM FOR SETTING DATE WHEELS IN A POSTAGE METER

The designer of a postage meter (or franking machine, the terms being used synonymously here) faces many competing and conflicting design requirements.

First and foremost the design has to satisfy the requirements of PTTs (postal authorities such as the U.S. Postal Service) around the world. The postal service is understandably fixated on the danger that a poor meter design might permit someone to print postage for which the postal service is not paid. Closely related to this is the concern that the design of the meter be such that any tampering with the meter will be readily apparent to relatively untrained postal service personnel during periodic meter inspections or during the activity of resetting a meter to contain more postage value. As a practical matter the manufacturer of the postage meter must also guard against the other direction, namely loss by the user of postage value for which the postal service has already been paid; the design features addressing the former generally also address the latter.

To satisfy the requirements of the postal service it is generally necessary to have a secure housing within which information is stored as to the amount of postage remaining to be printed or that has been printed. In the United States, for example, the storage location is called a descending register and it indicates the amount of postage remaining to be printed; in such countries the postage is prepaid. In other countries the storage location may be called an ascending register and indicates the cumulative amount of postage that has been printed; the postal customer pays after mailing.

It is also generally necessary to use a print rotor to print postage, rather than any of numerous other printing technologies that might be employed, since the postal authorities are comfortable with the notion of partially enclosing the print rotor within the secure housing. Partially enclosing the print rotor within the secure housing permits the printing dies to be protected from misuse during nearly all phases of meter operation. The postal authorities are also comfortable with the notion of the print rotor being a pure mechanical device even if the main body of the postage meter contains some electronics. The comfort comes from the notion that tampering with the rotor, if it is purely mechanical, will be easy to detect through visual inspection. One of the most difficult aspects of designing a postage meter is figuring out how the rotor will be interconnected with the rest of the postage meter, as will be discussed further below.

Postal authorities generally require that the meter be capable of printing user-selected postage amounts, and require that the meter be capable of printing the date on the mail piece as well. Depending on the mail class (also called "mail type") the postal authorities may require that the meter print information indicative of the class of service being used (e.g. first class, fourth class, presorted Zip+4, etc.). In a pure mechanical print rotor this requires that there be print wheels for postage value (also called value wheels), print wheels for the date, and movable dies for such things as the class of service.

As mentioned above, the postal authorities require that the design of the meter reduce to an absolute minimum the possibility of postage being printed for which payment has not been made. This requires a reliable linkage between the value wheels of the rotor and the ascending or descending register mechanism or electronics of the main body of the meter. Such a linkage has to satisfy many requirements. The value wheels have to be under complete control at all times; there cannot be any times when they are free-wheeling and thus subject to intended or accidental mispositioning. Despite this the rotor has to be capable of rotating through hundreds of thousands of franking operations. Enormous amounts of engineering time and money have been expended to explore ways to link the value wheels and other moving parts with the main body of the meter. One approach to rotor linkage is set forth in U.S. Pat. No. 4,639,581 to Berger et al., assigned to the same assignee as that of the present invention. That patent is directed to an H-shaped rotor shaft having racks along the length of the shaft. The racks move axially to adjust the positions of the value wheels. Pinions in the main body of the meter engage with the racks, and the orientation of the pinions and racks is chosen to permit the rotor to rotate when necessary. When the rotor begins to rotate the pinions and racks come out of engagement, and when the rotor completes a revolution the pinions and racks come back into engagement.

Those skilled in the art will appreciate that numerous other requirements also present themselves besides the above-mentioned requirements for the rotor linkage. The weight and size of the meter cannot be too great. The design should be mechanically robust against unintentional and intentional abuse, and should be reliable after many hundreds of thousands of operations. In general it is desirable to reduce the parts count of the postage meter, since parts have to be fabricated and assembled and can break. Finally, it is desirable to offer a rich mix of features to the user.

The limited space for moving parts, the fact that the rotor has to be able to rotate, the requirement that the value wheels be locked when the rotor is rotating, the fact that the total parts count and complexity of the meter must not be too high, the imperative that the meter be extremely reliable, and the collective experience of mechanical designers in the postage meter art, all lead to the realization that there is a sort of a "control budget", a limit on how much interaction there can be between the main body of the meter and the print rotor. In the vast majority of postage meter models in service the entirety of the control budget is entirely spent on the mere control of the value wheels; there is little or no control budget left over for controlling other moving parts such as the date wheels, the type-of-sending die, the advertising plate, etc.

In many postage meter models the date wheels are adjusted manually by the user, as are the printing dies indicating class of service and the like. In such a model the mechanical linkage between the rotor and the main body of the postage meter is as simple as it can be, and is limited to the linkage required to set the value wheels. In such a model the rotor itself is also about as simple as it can be. Stated differently, if one wanted to minimize the complexity of the interconnection between the rotor and the main body of the meter, and to minimize the complexity of the rotor itself, among the things one would do is to eliminate automatic, mechanical control of as many things as possible, and to leave as many things as possible to be set manually by the user. By far the majority of postage meters in use around the world are meters of just this type. At the start of each new day the user has to manually adjust the date that will be printed.

Manual date adjustment is not easy for the user. The user has to open a cover, visually inspect the date print wheels, and rotate the wheels. The visual inspection is not easy because the indicia on the wheels present a mirror image. The "8" and "0" indicia look normal but the other digits are reversed. The mirror image is not only problematic because individual digits are not easy to distinguish but for the further reason that the layout of digits is reversed. It is all too easy to set a date of "21" when "12" is meant, for example. Yet another reason the visual inspection is not easy is that the swinging cover typically at least partly obscures the field of view even when it is open.

In the most common postage meter models the way the user rotates the date wheels is by pushing them with a stylus or a ball-point pen. The manipulations are not easy because the swinging cover that is opened to gain access to the rotor partially obscures the access to the date wheels.

A further drawback of manual date adjustment is that the adjustment might be forgotten, in which case anywhere from one to several thousand mail pieces might be franked before the omission is noted and rectified.

It will be appreciated that making a manual date wheel adjustment possible requires providing an openable cover. The cover itself represents further design difficulties, as it cannot simply be a door that opens. It has to be a cover that opens to expose only part of the print rotor, since other parts of the rotor (such as the value wheels) have to be protected, to every extent possible, from tampering. It has to be a cover that is interconnected with other mechanisms of the meter so that (1) the user will not be able to initiate franking while the cover is open; and (2) the user will not be able to open the cover if the rotor somehow stops partway through a franking operation (e.g. due to loss of power). Such a cover has a complicated mechanical interconnection with the main body of the postage meter.

Designers of postage meters thus face pressure in two directions. On the one hand, it would be desirable to have automatically set date wheels. This would provide a meter that offers feature benefits to users, including greatly reduced incidence of accidental franking with an incorrect date. But the limited control budget available in the context of a rotor which rotates relative to a main body makes it desirable to minimize the complexity of the linkage, so that only the value wheels are set automatically, and everything else (including the date wheels) gets set manually.

Some sense of the magnitude of difficulty in designing a suitable mechanism for automatic setting of date wheels may be seen from the great attention that has been paid to sidestepping the problem. See, for example, Pitney Bowes U.S. Pat. No. 4,283,721 to Eckert et al. entitled Electronic Postage Meter Having Check Date Warning, applied for in 1979, in which a postage meter is turned on at the beginning of a work day. Upon startup, the equipment is prevented from operation in the initialization state, until such time as the date wheel cover is opened and closed at least once. The assumption if that this will prompt the user to set the date wheels as necessary since the date wheel door is open. As another example, see Pitney Bowes U.S. Pat. No. 4,347,506 to Duwel et al. entitled Electronic Postage meter Having Check Date Warning With Control For Overriding The Check Date Warning, applied for in 1981, in which power is initially applied to a postage meter. When power is applied, operation of the postage meter is inhibited until a date wheel cover is opened and closed at least once. In addition, however, a check date warning override key is provided, upon activation of which the meter enters its operational mode even though the date wheel cover has not been opened and closed. See Pitney Bowes U.S. Pat. No. 4,516,014 to Eckert entitled Date Checking Device For Electronic Postage Meter, applied for in 1982, in which a mailing machine is first prepared for operation by turning on a power switch. Upon initial start-up, the processor of the meter causes a check date indicator on the display panel to start flashing for the purpose of warning the operator to check the date that is set at the date wheels. The processor also disables postage printing. The user opens the cover to adjust the date wheels as needed, then presses a button. Pressing the button prompts the processor to extinguish the check date indicator and to enable the printing of postage. As yet another example, see Pitney Bowes U.S. Pat. No. 4,635,204 to Jones et al. entitled Postal Meter With Date Check Reminder Means, applied for in 1982, in which a postal meter is energized. When the postal meter is energized the processor causes its display to start displaying and flashing a check date indicator segment. The only way to make the processor stop the flashing is to open the date wheel cover and to press a key, the key being located nearby to the place where date wheels are set. If it were an easy matter to control date wheels automatically, the elaborate reminder strategies just recounted would not have been necessary.

U.S. Pat. Nos. 4,852,482 to Storace, 4,649,489 to Denzin, and 5,197,042 to Brookner et al. each talk of setting date wheels, but none of them appears to address setting date wheels in a print rotor.

U.S. Pat. No. 3,869,986 to Hubbard bears mute testimony to the difficulty of finding a way to adjust mechanical print wheels for the date and the postage value. The patent shows a print apparatus for a postage meter in which portions of the print image are by means of a relief printing die, while other portions (i.e. the date and postage value) are printed by an ink jet printer.

U.S. Pat. No. 4,060,720 to Check Jr. hypothesizes the user of encoders that are directly engaged with date wheels, the output of which would provide information as to the present settings thereof. The patent is directed to noting the difference between the actual and desired date wheel positions and adjusting the date wheels accordingly. The system of the patent does not, apparently, contemplate application in a postage meter having a print rotor, since no indication is given as to how numerous encoders would be fitted into a rotor of finite size, nor is there an indication as to how the dozen or more signals from the encoders would be communicated between the rotor (which rotates) and the main body of the meter.

U.S. Pat. No. 5,301,116 to Grunig, assigned to the same assignee as the present invention, describes an approach for automatic date wheel setting in a print rotor. When it is desired to adjust a date wheel, the rotor is brought into a particular angular relation with the main body of the meter (here, also called the "stator"). When the angular relation is reached a beveled shaft engages a slotted shaft, one of which is on the rotor and the other of which is on the main body. Each actuation of the shafts is coupled by a mechanism to the date wheels, so that any desired advancement of the date wheels may be accomplished by a sufficient number of actuations of the shafts. The setting is essentially serial and upwards only.

Swiss Pat. No. CH 418,705, assigned to the same assignee as the assignee of the present application, shows a date wheel indexing mechanism mounted in the rotor and controlled by a hand driver axial cam curve. The wheels are blocked most of the time from movement. The cam, which has two active surfaces, revolves through four phases under hand control. During the first phase, the first active surface actuates a cam follower to unblock the date wheels. During the second phase, the second active surface actuates a cam follower to advance the date by one position, by a ratchet mechanism that is not described in detail. During the third phase, the first active surface blocks the wheels again.

U.S. Pat. No. 4,520,725 to Haug (counterpart to European Pat. No. EP 105,424) shows a mechanism for setting date wheels, particularly in FIGS. 1–4. To be able to adjust four date wheels, the mechanism calls for six electromagnets and associated linkages and pawls. The electromagnets, linkages and pawls are part of the main body of the postage meter and for successful setting the rotor must be in proper alignment with the linkages; the extent of rotor alignment that permits adjustment of the value wheels does not necessarily assure that the rotor is well enough aligned to permit adjustment of the date wheels. The mechanism of Haug, with ratchet gears integrally formed with the date wheels, leads to visual gaps between the printed digits to accommodate the ratchet teeth. There is no overlap between the moving parts that accomplish date wheel and value wheel setting, so that the decision to employ the date wheel setting mechanism of Haug leads to a very high parts count and allocation of substantial volume and weight to the date-setting mechanism. It will also be appreciated that the mechanism of Haug also calls for semiconductor drivers for each of the six solenoids, separate and apart from the drivers needed for the value wheel setting.

Swiss Pat. No. CH 670.524 to Schlegel, assigned to the same assignee as the assignee of the present invention (counterpart to PCT publication WO 87/03983), describes a system having racks for setting value wheels. One of the value-wheel racks, when extended to an extreme position, permits all the other value-wheel racks to come into engagement with date wheels. When the date-wheel setting is complete, the value-wheel rack that is in an extreme position returns to a normal position and the other racks are no longer engaged with the date wheels. This system assumes that the value-wheel racks can all move independently of each other.

A Francotyp-Postalia EFS3000 mechanism is also known in which date wheels and value wheels are set by six racks, each of which has an individual stepper motor. Each of the six stepper motors is individually actuable independently of the other stepper motors. Four of the six racks serve a double purpose, namely controlling respective value wheels and also controlling date wheels. Of the four double-purpose racks, three are used to set (or preload) ratchet conditions for respective date wheels, and a fourth is used to actuate ratcheting of whichever of the three date wheels has been preloaded. The mechanism only adjusts three wheels (month, and units and tens of date). The mechanism requires that racks be independently movable relative to each other. It also has a relatively high parts count and the levers actuated by the racks to preload and ratchet the date wheels are long and take up a lot of space. The mechanism thus has most if not all of the drawbacks of the mechanism of Schlegel, mentioned previously.

U.S. Pat. No. 5,154,118 to Doery et al. describes a system for setting date wheels in a print rotor. When it is desired to increment the date, a finger in the main body of the meter extends toward the rotor and engages a tooth in a gear positioned to receive the finger. The gear is linked to an escapement much like an automobile odometer, so that actuation of the finger can accomplish advancement of the date. An elaborate mechanical linkage with three times as many gears as there are date wheels, and with numerous cams and truncated teeth, is provided to bring about the desired interrelated movements of the day wheel (units and tens), the month wheel, and the year wheel. The mechanism must, of course, be completely changed depending on whether the desired print order is month, day, year (as in the U.S.A.) or day, month, year (as in Europe). The setting is serial and upwards only.

U.S. Pat. No. 4,114,533 to Kittredge describes a system for setting date wheels. A large frame is positioned nearby to the date wheels, and contains as many solenoids as there are date wheels. Each solenoid is engaged with a transfer gear also supported within the frame. The frame is pivotally mounted and can rotate between a first position in which the transfer gears and other moving parts of the frame at some distance from the date wheels, and a second position in which the transfer gears all mesh with the date wheels. When it is desired to change the positions of one or more date wheels, a large solenoid causes the frame to rotate from the first position to the second position. Next the transfer gear solenoids are actuated as needed to change the date wheel positions. Then the large solenoid is deenergized and the frame springs back to its first position.

The mechanical arrangements set forth in Doery et al. and Kittredge each have a drawback; each arrangement adds to the list of mechanical elements that have to be properly lined up when the rotor is in position for setting (typically called a "home" position). Stated differently, it would be very helpful if the mechanism used for setting print elements other than the value wheels (e.g. the date wheels) did not increase the number of engaging elements that have to be lined up properly between the rotor and main body, beyond the number of elements that have to be lined up for setting of the value wheels. In the arrangement of Doery et al. the concern is that if an attempt were made to actuate the finger at a time when the finger is not correctly lined up with the gear, at the very least the date wheel setting might not achieve its desired result, and there is the danger the finger or some other elements would be damaged in the attempt to actuate the finger. In the arrangement of Kittredge the concern is that if an attempt were made to actuate the transfer gears at a time when they are not correctly lined up with the date wheels, at the very least the date wheel setting might not achieve its desired result, and there is the danger the transfer gears or some other elements would be damaged in the attempt to actuate the transfer gears.

The arrangement proposed in Schlegel offers an advantage over Doery et al. and Kittredge et al. in that the linkages between the main body and the rotor that are used for the value wheel setting are the same linkages that are used for date wheel setting. Thus, assuming the mechanical designer figures out how to be sure that the rotor is correctly lined up for value wheel setting, then the rotor will also be correctly lined up for date wheel setting.

Schlegel, however, also has a drawback in that, as mentioned previously, it assumes that there are as many stepper motors as there are value wheels to set, and that the stepper motors may be independently moved in varying directions. Among other things this requires setting aside space for the motors, for their control circuitry, and for their linkages.

It is thus very desirable to have a way to set date wheels that does not require linkages between the main body of the meter and the rotor, in addition to those minimally required for postal-authority-approved setting of value wheels. Such an arrangement desirably has a parts count that does not go far beyond the parts count for a rotor having manual date wheel setting. The arrangement would also desirably be able to count up or down in reasonable periods of time; if it is needed to back up by one day it is desirable that this be mechanically possible without having to cycle through a years' worth of dates, or through the entire range of all possible dates for the date wheels. Finally, it is desirable that this be accomplished in a rotor of commercially practical size, and in a meter of commercially practical shape and size, and it should not cost too much money.

A further impediment to the designer of a postage meter is that the designer has only limited control over the environment surrounding the date wheels. The date wheels are in the paper path, and thus may pick up debris or lint from mail pieces. If the meter is used in a dusty or hostile environment, then dust and other contaminants may be carried through the air to the date wheels. There is the possibility of over-inking by a user, and the possibility of a user attempting to ink the meter with stale or incorrect ink. The meter might also be exposed to variations in temperature tending to congeal foreign matter between adjacent wheels, thus setting up sticking friction therebetween.

For all these reasons, if a mechanism is provided to adjust date wheels, there is the problem in that it is possible that rotating one date wheel to set its position might drag along a neighboring date wheel, disturbing the setting of the neighboring date wheel. The extreme case may be seen if there are, say, four date wheels and if the first and third date wheels are advanced by one position. Friction on either or both sides of the second date wheel could result in its being dragged along out of its previous position.

It might be thought that the way to overcome the problem of wheels dragging other wheels is to use stronger and stronger detents. This is unsatisfactory for two reasons. First, strengthening the detents ripples back through the setting mechanism, forcing the designer to apply more force throughout the setting mechanism. This influences many design decisions throughout the meter, potentially requiring the meter to be heavier, more costly, slower, or bulkier, or forcing the designer to compromise on user functionality.

Second, experience shows that foreign matter and hostile conditions can lead to sticking friction between date wheels sufficient to overcome any detent, no matter how strong, up to the practical limits for detent strength.

Yet another design approach is to make the date wheel stack more complicated, with non-moving disks located between the date wheels. That way, rotation of one date wheel is not transmitted, by friction, to neighboring date wheels. This approach is inelegant because it adds to the parts count and complexity of the postage meter, and adds to the assembly time and cost because more parts have to be juggled to assemble the date wheel stack. But more importantly, it adds to the physical bulk of the date wheel stack. Space is always very tight in a print rotor, and making the date wheel stack bigger takes up space in the rotor that might be used for something else, or forces the designer to make the rotor (and thus the postage meter) bigger.

It would thus be highly desirable to have a date wheel setting design that is compact, reliable, and has a small parts count, and that is nonetheless immune from the problem of one date wheel dragging along another.

SUMMARY OF THE INVENTION

In accordance with the invention there is provided a greatly improved system for setting date wheels in a postage meter. Each value wheel is adjustable by a linkage that moves through a range of positions sufficient to select any of the ten print indicia thereof. According to the invention, however, several of the linkages (enough for the date wheels that need setting) are able to move further (to what might be termed an "eleventh position"), beyond the positions for the ten indicia of the value wheels. When such a linkage moves to its eleventh position, it moves a pawl that ratchets a corresponding date wheel to its next position. In one embodiment the linkages include rack elements that move along the axis of the print rotor. Each rack element has a first rack that is engagable with a gear in the main body of the postage meter (when the rotor is in its "home" position) and a second rack that engages with a value wheel. The engagement between the rack element and the value wheel defines ten linear positions for the rack element, one for each of the digits printable by the value wheel. An eleventh position of the rack element causes the rack element to push a lever, and the lever causes the pawl to move a date wheel to its next position. If only the mechanical parts are considered the date wheel setting system is "open loop"; there are no sensors that would detect, for example, a date wheel having moved for reasons other than actuation of the ratchet. But a method of operation is provided that permits the postage meter, with the assistance of the user, to accomplish recovery from an incorrect date wheel position.

In keeping with the invention, for each of several settable date wheels on a common axle, there is provided an advancing means disposed to advance its corresponding date wheel by one or more positions. Importantly, the several advancing means are disposed so that relative to the axle, one means advances its date wheel clockwise, the next counterclockwise, and so on in alternation. Since each advancing means not only serves to advance its corresponding date wheel in a predetermined direction but also serves to block its corresponding date wheel from retrograde rotation, it is not possible for a wheel that is being advanced to drag along its neighbor.

BRIEF DESCRIPTION OF THE DRAWING

The invention will be described with respect to a drawing in several figures, of which:

FIG. 11*a* shows an arrangement of print indicia in a prior art postage meter; and FIG. 11*b* shows an arrangement of print indicia in a postage meter according to the invention.

DETAILED DESCRIPTION

Figure 1:
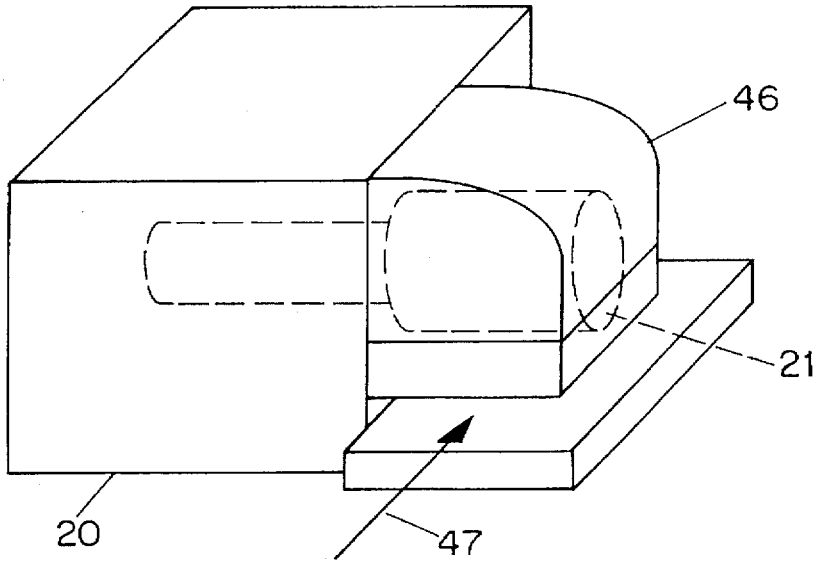
FIG. 1 is an exterior perspective view of a postage meter according to the invention, including a print rotor 21 shown in phantom.

FIG. 1 is an exterior perspective view of a postage meter according to the invention. Main body 20 may be seen, and a print rotor 21 is shown in phantom. Access to the print rotor 21 may be had by opening a cover 46, although as described below the cover 46 does not need to be opened nearly so often with the meter according to the invention as with many prior art postage meters. A mail piece enters the meter in the direction shown by arrow 47, trips a trigger omitted for clarity in FIG. 1, and the rotor 21 rotates to print postage value on the mail piece. Most of the time, the rotor is in what is defined to be a "home" position. When the trigger is tripped, the rotor rotates through one complete revolution, and stops again at its home position.

Figure 2:
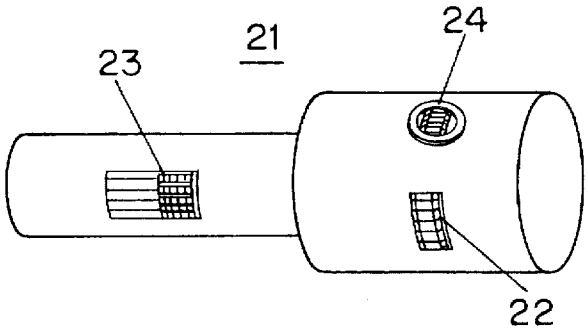
FIG. 2 is a perspective view of the print rotor 21, including racks 23, value wheels 22, and date wheels 24.

FIG. 2 is a perspective view of the print rotor 21, including racks 23, value wheels 22, and date wheels 24. The value wheels 22, of which there are generally four or five, each have ten faces with indicia thereon indicative of decimal digits. The angular positions of the value wheels 22 must be strictly controlled by the mechanisms of the rotor and of the main body of the postage meter, so that there is never any doubt as to the amount of postage value being printed at any particular time. A locking mechanism, omitted for clarity in FIG. 2, holds the value heels 22 into their positions when the rotor 21 is out of its home position. A cam in the main body of the meter, the cam being omitted for clarity in FIG. 1, releases the locking mechanism when the rotor 21 is in its home position. The locking mechanism serves not only the above-mentioned locking function, but also serves as a detent, tending to urge each value wheel so that its indicium is squarely presented for printing on the mail piece.

The date wheels 24, of which there are typically four, have twelve faces each, with each face bearing an indicium. One wheel prints the month (hence the twelve faces), another wheel prints the year, and the two remaining wheels print the units and tens of the date. The wheels have detent mechanisms, not shown in FIG. 2 for clarity, tending to ensure that each wheel presents one of its twelve faces squarely for printing its indicium on the mail piece.

Figure 3:
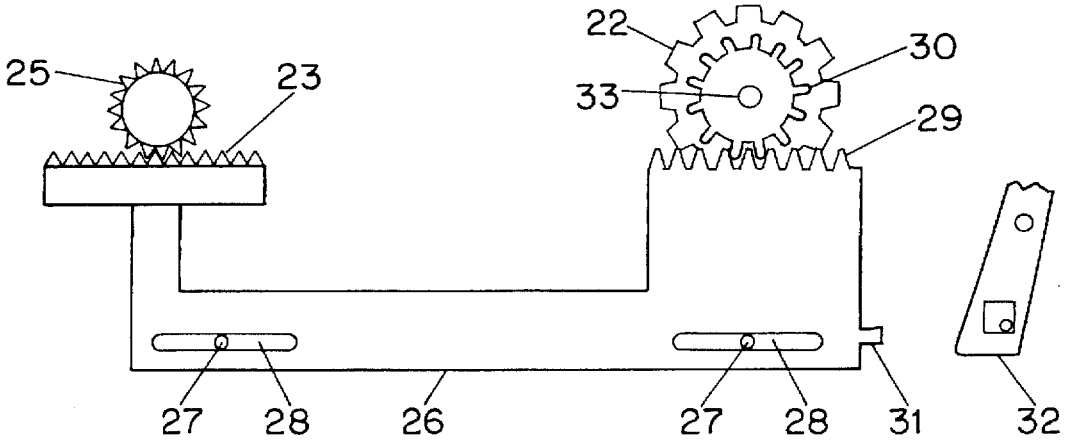
FIG. 3 is a side view of a portion of the print rotor 21, showing the value wheel adjustment mechanism including a rack 23 and value wheel 22 as well as part of a date-adjusting lever 32.

FIG. 3 is a side view of a portion of the print rotor 21, showing the value wheel adjustment mechanism including a rack 23 and value wheel 22 as well as part of a date-adjusting lever 32. It will be appreciated that all the elements shown in FIG. 3, save the gear 25, move with the rotor when it rotates. In the view shown in FIG. 3 this movement is out of the page.

The rack member 26 moves to the left and the right in FIG. 3 to set its value wheel 22. The rack 26 has slots 28 which run on pins 27. The length and position of the slots is selected to permit movement of the rack member 26 so that the entirety of its rack 23 is able to engage the gear 25. The rack 29 engages with a gear portion 30 of the value wheel 22. As will be discussed in more detail below, the range of movement of the rack member 26 is intentionally designed to be greater than would be needed to effect all ten positions of the value wheel 22. The value wheel 22 rotates about a pin 33.

The mechanism just described is repeated several times in the rotor and appears once for each value wheel 22. Thus, if there are five value wheels 22 in the meter, then there are five rack members 26, five racks 23, and five gears 25. The same may be said of FIG. 2, where there are five racks 23 and five value wheels 22.

For most of the rack members 26 (but not necessarily all of them) there is a respective lever 32. Lever 32, which will be described in more detail below, adjusts the position of one date wheel. It is pushed by feature 31 of the rack member 26.

The geometry and relative positions for the rack member 26 and the lever 32 are selected so that all of the ten faces of the value wheel 22 may be obtained without the feature 31 touching the lever 32. But if the rack member 26 moves further to the right in FIG. 3, it is able to move far enough to move lever 32 to the right through its range of motion.

The number of levers 32 is selected to match the number of automatically settable date wheels 24, typically four. Thus, if there are four automatically settable date wheels 24 (not shown in FIG. 3) then there are four levers 32, only one of which appears in FIG. 3.

It might appear from FIG. 3 that the rack 23, the rack 29, and the lever 32 are all coplanar. But as will be seen in FIGS. 5 and 6, in an exemplary embodiment they are not coplanar. In the exemplary embodiment lever 32 is in a different plane than rack 29 because the date wheel 24 and value wheel 22 which they respectively control are in different planes.

Figure 4:
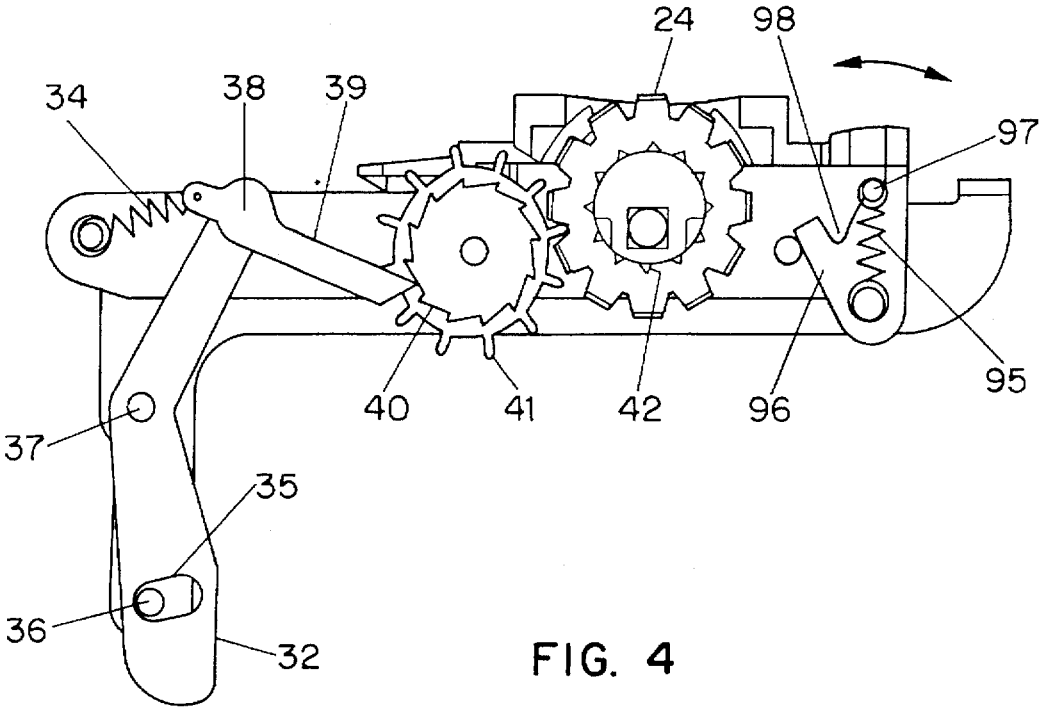
FIG. 4 shows a side view of a portion of the print rotor 21, showing the date wheel adjustment mechanism including the date-adjusting lever 32 and date wheel 24.

FIG. 4 shows a side view of a portion of the print rotor 21, showing the date wheel adjustment mechanism including the date-adjusting lever 32 and date wheel 24. The view of FIG. 4 is in mirror image to the view of FIG. 3; movement of lever 32 to the right in FIG. 3 corresponds to movement of lever 32 to the left in FIG. 4. Lever 32 is hinged to pawl 39 at a pivot point 38, detail of which is omitted for clarity in FIG. 4. Return spring 34 accomplishes two results: it urges lever 32 to its extreme counterclockwise position against pin 36, and it urges pawl 39 into uninterrupted contact with the ratchet wheel 40. Ratchet wheel 40 is integral with gear 41, which engages date wheel 24.

The teeth of gear 41 and of ratchet wheel 40 may be (but need not absolutely be) twelve in number, matching the number of faces of date wheel 24. A detent mechanism engages dimples 42 to urge date wheel 24 into one of its twelve angular positions, so that one of the faces is squarely presented for printing.

From FIG. 4 it is easy to see what happens when lever 32 moves to the left. When lever 32 moves to the left, which represents clockwise rotation, it pivots about pin 37. That movement causes pivot point 38 to move rightwards, moving pawl 39 rightwards. The pawl 39 engages a tooth of ratchet wheel 40, causing it to move about one-twelfth of a revolution counterclockwise. This causes date wheel 24 to move about one-twelfth of a revolution clockwise, preferably stopping at its next detent position defined by the dimples 42. The detailed geometry of the pawl 39 and ratchet wheel 40 are selected so that when the wheel 24 stops at its next detent position, the pawl 39 is unable to urge ratchet wheel 40 any further, except for a small overstroke to compensate for tolerances. The small overstroke does not lead to a mispositioning of the date wheel because the detent returns the date wheel to its centered position.

It will be recalled that pin 36 and hole 35 defined the maximum clockwise rotation of lever 32. As just described, this maximum clockwise rotation will have caused the date wheel 24 to move almost exactly one-twelfth of a revolution, from one detent position to the next. It is also easy to see what happens when the lever 32 is released. Return spring 34 urges pivot point 38 leftward, which urges pawl 39 leftward and also rotates lever 32 counterclockwise. The movement counterclockwise of the lever 32 halts with the abutment of pin 36 and hole 35. This defines the resting location of the pivot point 38, and that pivot point, together with the point at which pawl 39 touches ratchet wheel 40, completely defines the resting position of pawl 39.

Lever 32 has a hole 35 which surrounds pin 36. A desirable aspect of the mechanism of FIG. 4 is that the hole 35, in cooperation with pin 36, provides stops that define the full clockwise and counterclockwise rotation of lever 32. The geometry of the hole 35 and the other elements of FIG. 4 assure that the pawl 39 reliably and repeatably engages ratchet wheel 40 to the extent of one tooth, no more and no less.

The moving parts just described in FIG. 4 are all preferably coplanar, and the details of the pivot points 37 and 38 confine the movement of the elements 32 and 39 strictly within that plane. As will be more fully appreciated in connection with FIGS. 5 and 6, there are other aspects of the design that serve further to constrain the movement of these moving parts within the plane. For example, although it is not shown in FIG. 4, there are other gears 41 stacked on the same pin or axle about which the shown gear 41 rotates. The teeth of the many gears 41 tend to keep the tips of the pawls 39 in place.

FIG. 4 shows the pawls 39 engaging with ratchet teeth on wheels 41, and wheels 41 engage in turn with date wheels 24. This arrangement is thought to be preferable since it permits the date wheels 24 to be closely spaced, and permits most of the width of each date wheel 24 to be devoted to print area. Those skilled in the art will appreciate, however, that without departing in any way from the invention, one could combine the functions of the ratchet wheels and the date wheels. For example, each date wheel could have a ratchet wheel formed integrally with it. The pawls 39 would thus engage directly with ratchet teeth on the date wheels 24. This presents the possible disadvantage that some of the width of each date wheel 24 would be taken away from use for print indicia, and would instead be given over for use in providing the ratchet teeth. This means the printed digits would have gaps between them.

Figure 5:
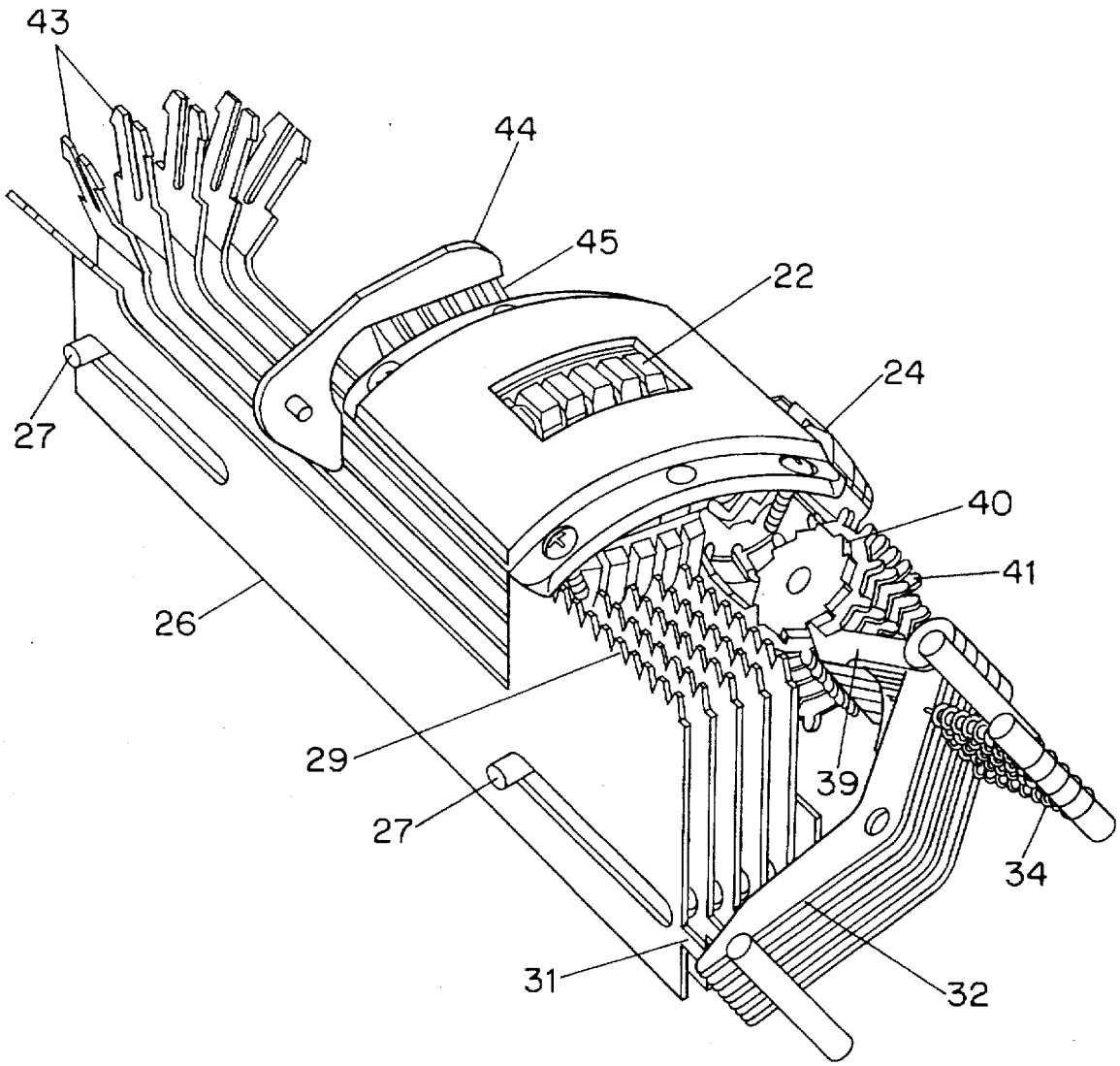
FIG. 5 shows a cutaway perspective view of most of the moving parts of the print rotor 21.

FIG. 5 shows a cutaway perspective view of most of the moving parts of the print rotor 21. The rack members 26 are disposed parallel to each other, collectively mounted on pins 27 which ensure that the rack members 26 move only axially within the print rotor. Features 43 (in FIG. 5) are mounting points for the racks 23 (FIG. 3). The features 43 are splayed to accommodate the racks 23, because each rack 23 is wider than the spacing between the rack members 26. (The splay of the features 43 is also visible in FIG. 6.) The racks 29 are visible, also disposed parallel to each other. The racks 29 are in continuous engagement with the value wheels 22. Locking arms 45 are seen with locking lever 44. Locking lever 44 is pushed downwards, in FIG. 5, by a cam in the main body of the meter, omitted for clarity in FIG. 5. When locking lever 44 is pushed downwards it rotates locking levers 45 and permits value wheels 22 to rotate freely.

The locking arrangement of lever 44 and arms 45 may optionally be that set forth in copending application Ser. No. 08/400,335, filed Mar. 7, 1995, which is incorporated herein by reference.

Levers 32 may be seen in FIG. 5, along with return springs 34 and pawls 39. The pawls 39 engage ratchet wheels 40, which turn wheels 41 and thus turn date wheels 24.

The position of the rack members 26 is in the full rightwards extent of possible movement in FIG. 5. Thus, the features 31 are each causing levers 23 to move to their extreme movement, counterclockwise in FIG. 5. (Counterclockwise movement of levers 32 in FIG. 5 corresponds with clockwise movement thereof in FIG. 4.)

Figure 6:
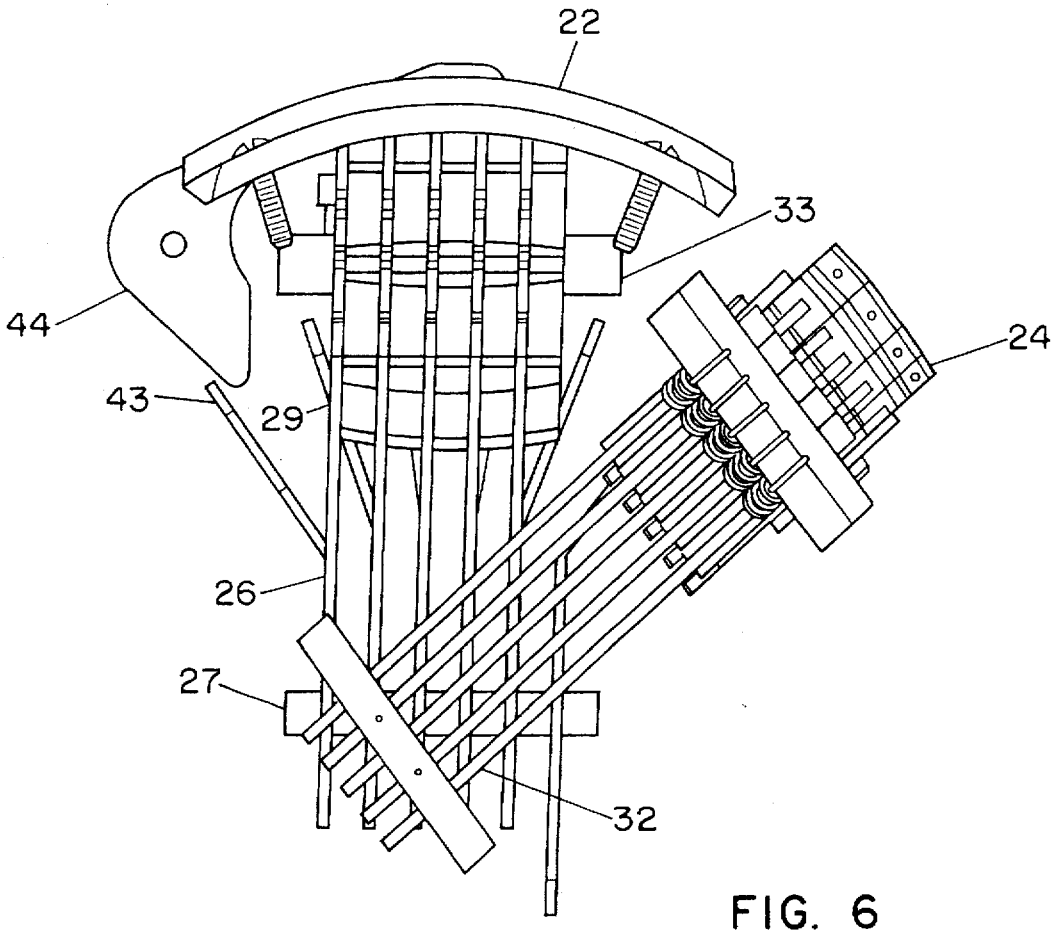
FIG. 6 is an axial end view of many of the moving parts of the print rotor 21.

FIG. 6 is an axial end view of many of the moving parts of the print rotor 21. Rack members 26 may now be clearly seen in their parallel positions. Pin 27 is also visible, as is locking lever 44 (FIG. 5) and pin 33 (see FIG. 3). Movement of a rack member 26 out of the page in FIG. 6 corresponds to movement to the right in FIG. 5 or to the right in FIG. 3 or FIG. 2. The splayed arrangement of the features 43 (FIG. 5) is also visible.

In FIG. 6 the angular placement of the value wheels 22 and the date wheels 24 within the print rotor is clear. The positions of the wheels are selected to reach the periphery of the rotor, so that as the rotor rotates counterclockwise (in FIG. 6) first the value wheels 22 come in contact with the mail piece, and later the date wheels 24 come into contact with the mail piece. FIG. 6 shows the value wheels 22 upwards for convenience of presentation, but it should be appreciated that the home position of the rotor is preferably such that the date wheels 24 are more or less upwards.

The gears 25 represent a portion of a control means in the main body of the postage meter, coupled in a reliable way with the ascending or descending register of the postage meter. A single motor, together with a number of solenoids, can be used to effect the desired movement of the gears 25 as set forth in copending application Ser. No. 08/422,155, filed Apr. 14, 1995, and entitled Single-Motor Setting and Printing Postage Meter, which is incorporated herein by reference. The rotor 21 (FIG. 2) may desirably be the rotor set forth in copending application Ser. No. 08/421,900, filed Apr. 14, 1995, and entitled Postage Meter with Hollow Rotor Axle, which is incorporated herein by reference.

It will be appreciated that the linkage according to which control in the main body of the meter is coupled to the value wheels can vary from the particular linkage set forth above. Without departing from the invention, the embodiment could be more generally described as follows. The main body comprises a secure housing, and within the secure housing there is a ascending or descending register of postage value remaining to be printed. If the meter is an electronic meter, then the ascending or descending register is preferably accomplished using one or more nonvolatile memories. Within the rotor are setting members corresponding to respective ones of the value wheels, said setting members operatively coupled with the control means, each setting member having teeth engaging the gear portion of the respective value wheel, each setting member movable to a first respective number of positions, one for each indicium of the respective value wheel. While the exemplary embodiment uses racks and rack members to link the control means and the value wheels, other setting members could be used, including additional gears if desired.

The manner in which the setting members are linked with the date wheels can also vary without departing from the invention. The date lever linkage could be more generally be described as comprising a follower portion and a pawl engaging the ratchet wheel of the corresponding date wheel assembly. In the simplest case, as described herein, the pawl engages a ratchet wheel that is integral with a gear that continuously engages a corresponding date wheel. More generally the ratchet wheel could be mechanically linked to its corresponding date wheel in other ways without departing from the invention.

The manner in which the setting members move to accomplish the setting of value wheels on the one hand, and the setting of date wheels on the other hand, can also vary without departing from the invention. Described more generally, the setting members are movable to any of a first number of positions corresponding with the number of printable digits (preferably ten) and movable to an additional position so as to actuate a follower portion of a corresponding date lever. In the exemplary embodiment this represents a rack member movable linearly through eleven positions, ten of which are meaningful print positions for value wheels, and the eleventh of which is the position that advances a date wheel. The linear movement could represent, in sequence, print digits 0 through 9 followed by advancement of a date wheel, but could just as well represent digits 9 through 0 or the digits in any other sequence, the correct positioning of which being accomplished in software.

The setting members and value wheels could be and preferably are substantially parallel to each other, but those skilled in the art could select other relative positioning including positioning each element in a plane passing through the axis of the print rotor. The same may be said of the date wheels and the elements mechanically linked thereto.

As was mentioned previously, the cover 46 of the postage meter according to the invention need not be opened very often. Accessible within the cover area are the ink roller, the advertising plate, the lever permitting the user to present or retract the date from printing, and the block that carries optional "mail type" dies, for example stating that the mail is being sent by presorted first class.

The manner in which date wheel setting is accomplished will now be described in some detail.

When the setting members are actuated (by the gears 25, in the exemplary embodiment) this is generally because it is desired to change the value wheel settings, and not to change the date wheel settings. This is for the simple reason that the value wheel settings change many times a day, while the date wheel settings generally change only once a day. In practical terms this means the gears 25 are actuated so that most of the time the setting members (in the exemplary embodiment, the racks) are confined in their movement to the ten positions associated with the ten indicia-bearing faces of the value wheels.

When it is desired to change the positions of the date wheels, this most often occurs because the calendar date has changed. This may arise in any of several different ways.

The postage meter according to the invention will keep track of the date on which it last printed postage, and upon power-up the meter will consult its internal clock/calendar to see whether the date has changed since the date on which it last printed postage. If the date has changed, then depending on the design choice of the meter manufacturer the meter will either (1) recommend a date setting to the user of the meter, for example by a display of a message, or (2) change the date as shown on the date wheels to reflect the present date.

The postage meter according to the invention will also keep track of the possibility that it may be powered up at a time when a change of the date wheels may be appropriate. For example, the meter may be left powered up around the clock for any of several reasons: the meter may be in active use around the clock, or may simply be left powered around the clock intentionally or through inadvertence. At the very least the event of midnight passing will desirably prompt updating the date wheels, or at least suggesting to the user that the date wheels be updated.

A more sophisticated plan may also be followed according to the invention, which takes into account the daily routine of those using the postage meter. For example, in the United States the postal authorities recommend that if metered mail is deposited in a mail box after the last scheduled pickup of the day, the metered date should be the next day when pickup is scheduled. As an example, suppose that the last pickup of the day is 5:00 PM Monday through Friday, and that mail is not picked up Saturday or Sunday. Suppose in addition that it takes fifteen minutes for mail that has been franked to reach the mail box. In this case, it would be desirable to design the meter so that it can be programmed to advance its date (or to suggest advancing its date) at 4:45 PM Monday through Friday. The advance to be performed on Friday would desirably be an advance of three days, so that the printed date would be that of the following Monday.

In a preferred embodiment an offset may be stored into the postage meter, so that the date wheels will advance not at midnight but at a present time before midnight. Desirably this offset is not changeable by the user, but is changeable only by authorized field service personnel.

It should also be appreciated that while most date wheel adjustments are expected to be in the forward direction, adjustments in the other direction can be expected from time to time. Some prior art date wheel adjustment mechanisms, as mentioned earlier, only permit automatic adjustment in the forward direction. At least three scenarios may be envisioned wherein retrograde movement of date wheels would be desired.

First, it may happen from time to time that a user may wish to frank some mail pieces today that will not be mailed until some future date. If so, the date wheels would need to be set ahead to the future date for the franking of the mail pieces that are to be mailed on that date, and then the date wheels would need to be restored to their normal date, such as today's date.

Second, in some countries there are mail classes for which it is required that the mailer imprint the month and year, but not the day of the month. In those countries the date wheels for the day of the month contain not only the digits 0 through 9, but also a character (a blank or a dash) that is used when the day of the month is not to be printed. A date wheel adjustment mechanism that only permitted forward adjustment of dates would not handle well the task of selecting digits, then blanks or dashes, then selecting digits again.

Finally, it is to be assumed that even if it happens only rarely, it will happen from time to time that one or more of the date wheels will be in a position other than the position that the software thinks the date wheels are in. Stated differently, it is desirable that at all times the software of the meter keep track of the presumed position of the date wheels, based on an initial position and based on keeping close track of all the changes of wheel position performed by the software through the setting means of the meter. Yet because there is no direct mechanical or electrical feedback from the date wheels themselves (in the exemplary embodiment, at least) the software has no direct mechanical or electrical way of knowing the exact positions of the date wheels themselves. The system is, from the electrical and mechanical point of view, an "open-loop" system; there is no electrical or mechanical feedback. So it may occasionally happen that a date wheel has a position other than that recorded by the software.

Such an occurrence is virtually impossible with respect to the value wheels because they are at all times either locked into place or linked in a robust way to setting and sensing mechanisms in the main body of the postage meter. But the date wheels are held into place only by detents and are moved by ratchets. As a consequence it is possible for a date wheel to move under circumstances other than actuation by the setting means of the rotor. To give one example, it may happen that the postage meter loses power at a time when one or more of the date wheels is in contact with a mail piece, in which case efforts by the user to extricate the mail piece might cause a date wheel to change position. To give a second example, the design of the postage meter may give the user access to the date wheels for user-initiated manual adjustment of the date wheels. If so, the user-initiated manual adjustments will lead to differences between the actual date wheel positions and the date wheel positions recorded in software.

In any of these cases it will be desirable, according to the invention, to close the loop by providing feedback regarding the positions of the date wheels. According to the invention this is provided by the user printing a sample mail piece, desirably using a postage amount of zero. The user then reads the date from the mail piece, and enters the digits of the date into the postage meter at a keyboard provided thereon. The date entered by the user is stored in the memory of the postage meter and is used by the software in subsequent calculations regarding suggested or automatic changes in the date wheel positions. It is anticipated that this step by the user will be required only rarely, since all or nearly all changes in date wheel settings will occur under program control rather than through inadvertence. As a consequence the step of asking the user to key in the date from a sample mail piece, since it will happen only rarely, is not expected to constitute a burden on the user of the postage meter.

As mentioned above, the mechanism according to the invention permits moving dates forward and backward. In this respect the mechanism of the invention offers benefits over many systems in which only forward motion is possible. Stated differently, in many systems for a date to be moved backwards it would be necessary to advance the date by several thousand counts, through all possible dates, until the date wheels "rolled over" rather like the odometer of a car that reaches 100,000 miles or 100,000 kilometers.

But it will also be appreciated that the mechanism according to the invention offers further benefits over many prior art arrangements in that the date wheel adjustment is substantially in parallel rather than serial. To illustrate this, consider the case of a postage meter that was last used on June 1 and goes unused for a month and a half. When the meter is next turned on it is desired to advance the date from June 1 to, say, July 15.

With some prior art serially set date wheel systems, such as those of U.S. Pat. No. 5,301,116 or Swiss Pat. No. CH 670,524 as mentioned above, there is a single actuator such as a solenoid which advances the date by one count. A "carry" mechanism is employed so that after the units digit changes from "9" to "0" the tens digit increments, and so that after the tens digit increments past "3" the month changes. With such a system an advance of the date from June 1 to July 15 requires at least forty-five actuations of the actuator (and with many designs the number of actuations is much more than forty-five, taking into account that dates beyond 31 must be skipped).

With still other serially set date wheel systems, such as that of U.S. Pat. No. 4,852,482 to Storace as mentioned above, there is a date actuator which can be moved back and forth to engage the units, or the tens, or the month, or the year. In such a system the time required to perform the date adjustment is the sum of the times required to adjust each of the date wheels together with the times required to move the actuator back and forth.

The system according to the invention, however, never requires more than eleven steps to adjust the date wheels to any desired date (including the year) regardless of the previous setting of the date wheels.

When the feedback loop is closed by user inputs, as it is in the meter according to the embodiment, there is the possibility that a user who wishes to frank mail with a misleading date may accomplish it. For example, as mentioned above when the meter is turned on, one of the first things it will do is ask the user to print a sample mail piece and look to see if the date is right. The user who is very familiar with the postage meter and its operation could answer the question falsely, stating that the date is not right. The user will then be prompted to key in, at the meter keyboard, the date that appeared on the sample mail piece. The user could then type in a date that differs from the date actually printed on the sample piece. The result would be that the meter has been tricked into setting its date wheels to an incorrect position.

To protect against this, the software of the meter is preferably set up so that instances of resetting due to user input are tallied. The meter stores within its memory a record relating to each such user input, each record containing the date and time at which the user input occurred, the values provided by the user that are expected to have been obtained from the sample mail piece, and the difference (negative or positive) between the expected and actual date wheel settings. If the number of such records is large, this may be an indication that would suggest to postal service personnel that the user has been tricking the meter to print misleading franking dates.

It might also be helpful to maintain statistics derived from the user-input date-change records. For example, if a user input record shows a two-day change in one direction (that is supposedly due to an incorrectly positioned date wheel) resulting in setting the date forward two days, and if a previous user input record shows a two-day change in the other direction (that once again was supposedly due to an incorrectly positioned date wheel) resulted in setting the date back two days, then this pair of records might be an indication of the user trying to trick the meter. So one statistic that might be kept is the number of times that pairs of user inputs occurred that resulted in a move back by a number of days and a move forward by the same number of days.

Ratios would also be helpful, for example, a total could be kept of the number of times the date has changed, and a total of the number of times a user input occurred relating to the date. The ratio of the totals would be helpful for diagnostic purposes and as an indication of possible attempts by a user to trick a meter into setting the wrong date.

It is helpful to keep a certain perspective regarding the detection of user inputs intended to trick a postage meter into printing the wrong date. After all, the vast majority of postage meters in present use have date wheels that are set only by the user, and with these meters there is no way to detect the user's fiddling with date wheels to backdate mail pieces.

Yet another type of statistic is also quite helpful for diagnostic purposes. For example, suppose that a pawl 39 is broken. The result of such breakage would be that the associated date wheel is not correctly set. In the system according to the invention this would first be noticed when the time came for that date wheel to move. For example, if the pawl 39 that is assumed to have broken is the one for the month wheel, then the breakage would be noticed when the month changes.

From the user's point of view, here is what would happen. The meter would be powered up in the new month. The software would note that the date has changed, and would attempt to advance the date wheels accordingly. The user would be asked to print a sample mail piece and to indicate whether or not the date is correct. The user would respond in the negative, entering in the date from the mail piece at the meter keyboard. The software would again attempt to set the date, this time actuating only the rack (and attempting to actuate only the pawl) for the month wheel. The user would again be asked to print a sample mail piece and to indicate whether or not the date is correct. The user would again respond in the negative, entering in the date from the mail piece at the meter keyboard. After a preset number of attempts the meter software would abandon the effort to set the date, and would enter a "call service" state, in which it would not be possible to print postage. The software would preferably note in its error log the identification of the particular date wheel (here, the month wheel) that was not set successfully.

One software arrangement usable in the postage meter according to the invention is to ask the user to confirm, after the date wheels have been adjusted, that the date wheels are in the correct position. There are two possible drawbacks to this arrangement.

First, many users will get in the habit that each day, when the meter asks this question, the answer will be unquestionably given in the negative. This may be compared with users who do other things out of habit, such as silencing an alarm clock or pressing a frequently pressed button in an elevator. The drawback with this is that the user will then print numerous mail pieces, perhaps to discover only much later that the date was wrong.

The other possibility is that the user may diligently follow instructions, printing a sample mail piece with a postage value of zero to obtain a print of the date wheel settings. This is likely to prove to be a wasteful habit, assuming the date wheels generally do get set correctly on the first try, as is desired by the designers of the date wheel arrangement according to the invention. This uses up ink, and wastes machine cycles of the franking machine. What's more, if the value wheels are inadvertently left in a non-zero position, the test will result in loss of postage value on the sample piece.

Figure 7:
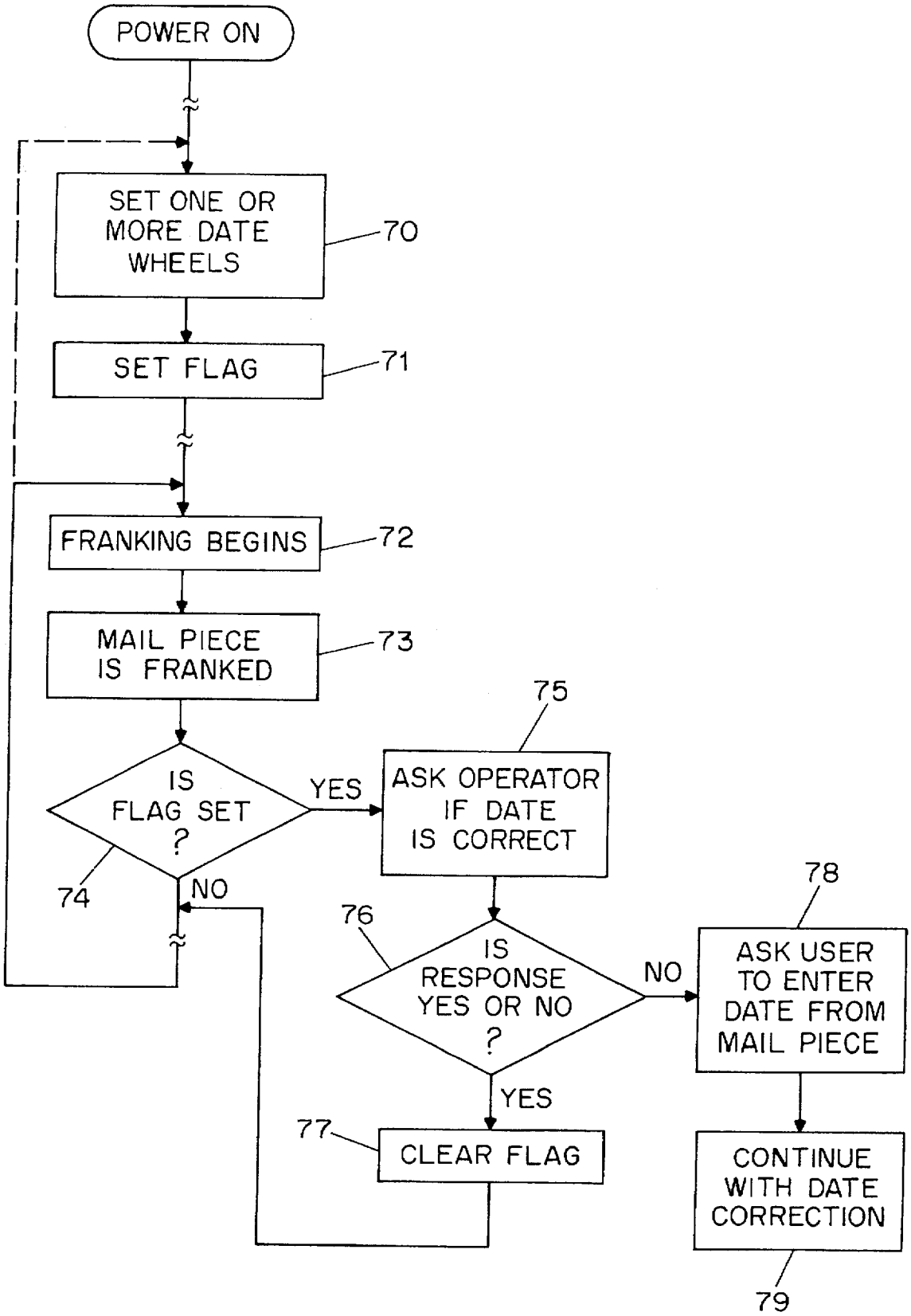
FIG. 7 is a flow chart of the date-setting method according to the invention.

This is shown for example in FIG. 7. Some time after power is applied the time comes to change the date as shown in box 70. This may occur, as discussed above, because the processor determines that the need for a date change occurred while the meter was powered down, in which case the date resetting desirably happens soon after power-up. On the other hand this need may arise at a time when the meter is presently powered, in which case the date resetting desirably happens during an idle moment.

In any case, if one or more date wheels has been set, a flag is set in box 71. The meaning of the flag is essentially that a flag has been set and the operator has not yet been asked whether the new date is correct, generally because no franking has taken place.

The broken line between boxes 71 and 72 denoted that a long time might pass between the time a date wheel setting takes place and the next time a mail piece is franked. The passage of a long time could happen because the operator turns on the machine at the beginning of the work day, and does not happen to frank any mail until much later in the work day. Another way the passage of time could be long is if the meter is left powered-on overnight and not used until the next day.

In any event, at box 72 franking begins. Generally this is either because an envelope or card has been passed into the meter, or because a meter strip is printed, indicated at box 73.

In keeping with the invention this is a good time to ask the operator if the date is correct. Thus, at 74, a test is made to determine whether the flag is set. If not, execution proceeds as usual to other meter activities such as printing more postage. On the other hand, if the flag is set, then at 75 the user is asked whether the date is correct. This may be by aural annunciation or by a display at the meter which is noticed by the operator, or by the somewhat less subtle step of blocking the printing of postage until the operator answers the question. In general, since the date setting mechanism is assumed to be highly reliable, the answer at 76 will be in the affirmative. The flag is cleared at box 77 and execution proceeds as usual.

In the case where the user answers in the negative, then the user is asked to enter the printed date at the keyboard (box 78) and the software continues with a recovery from the error condition.

Thus it is desirable, according to the invention, to proceed in a way which is apparently unknown in the prior art, namely to keep track of the event of one or more date wheels having been sent, and further to keep track of the event of a first mail piece being franked, which might be long after the event of setting a date wheel. After the second event, it is desirable to annunciate to the user the query whether the date is correct. This avoids the problem of wasted ink and wear and tear for the printing of sample pieces with no postage value in place. In this way a system which appears at first glance to be only "open loop" with no feedback is in fact "closed loop", with feedback, and the feedback path is well integrated into the routine of the human operator.

One skilled in the art will appreciate that for the above-described closed loop date setting system to function, it is necessary that the user be able to communicate to the meter the date that is printing on mail pieces. The user prints an item of postage (which may be either a test piece with a zero postage value or a regular mail piece) and, if the date is wrong, the user communicates the incorrect date to the meter. In a preferred embodiment this communication takes place by way of numerical entries on the numeric keyboard of the postage meter.

But referring now to FIG. 11*a*, which shows a prior art print wheel sequence for the units and tens of the day of the month, it will be appreciated that it is not easy for the user to enter all possible printed dates by means of numeric keys. For example, if the printed day were "2-" the user would not necessarily be able to enter this into the meter, as there is no "–" key on a numeric key pad. Likewise there is the potential for ambiguity in that the printed day might include one or more blank spaces (shown as "b" in the figure) and the user could be uncertain how to enter the blank space at the numeric keyboard.

FIG. 11*b* shows a way to overcome this difficulty. The two digits on the "units" date wheel that might previously have been engraved with a "–" or space are engraved with "9" and "0" as shown. This permits correcting an incorrect date in a maximum of two user interactions. For example, if the printed digit was a "9" and the desired digit was a "4", the software advances the unit wheel by six positions. Depending on which of the "9" faces had been printing, the new wheel position will either be a "3" or a "4". One more user test is performed with a sample mail piece, and if the result was a "3" the wheel is advanced by one more position.

Stated more generally, if the incorrect digit is one that appears more than once on the wheel, so that it is not certain which of the faces bearing that digit is printing, then the wheel is advanced by the smallest number of positions that might leave the wheel in the correct position. The user is asked to print a test piece, and if necessary the wheel is advanced yet again.

The drawing of FIG. 11*b* suggests that the units wheel and the tens wheel of the day would both advance in the same direction, e.g. both clockwise or both counterclockwise. The portrayal of FIG. 11*b* is shown in this way only to parallel the portrayal of FIG. 11*a*, however. In keeping with the invention the units and tens wheels would advance in opposite directions.

As was mentioned above, many proposed mechanisms for setting date wheels of a postage meter have called for ratchet movements. Repeated actuation of the ratchet advances the corresponding date wheel repeatedly. But there is the difficulty that if one date wheel is advanced, one or more of the neighboring date wheels may be dragged with it as it advances. Space is tight in a postage meter rotor, so there is little room for more parts to solve this problem. For example, placing fixed disks between the rotatable date wheels can keep one date wheel from dragging along a neighboring date wheel, but at the cost of making the date wheel stack thicker and more complicated.

Figure 8:
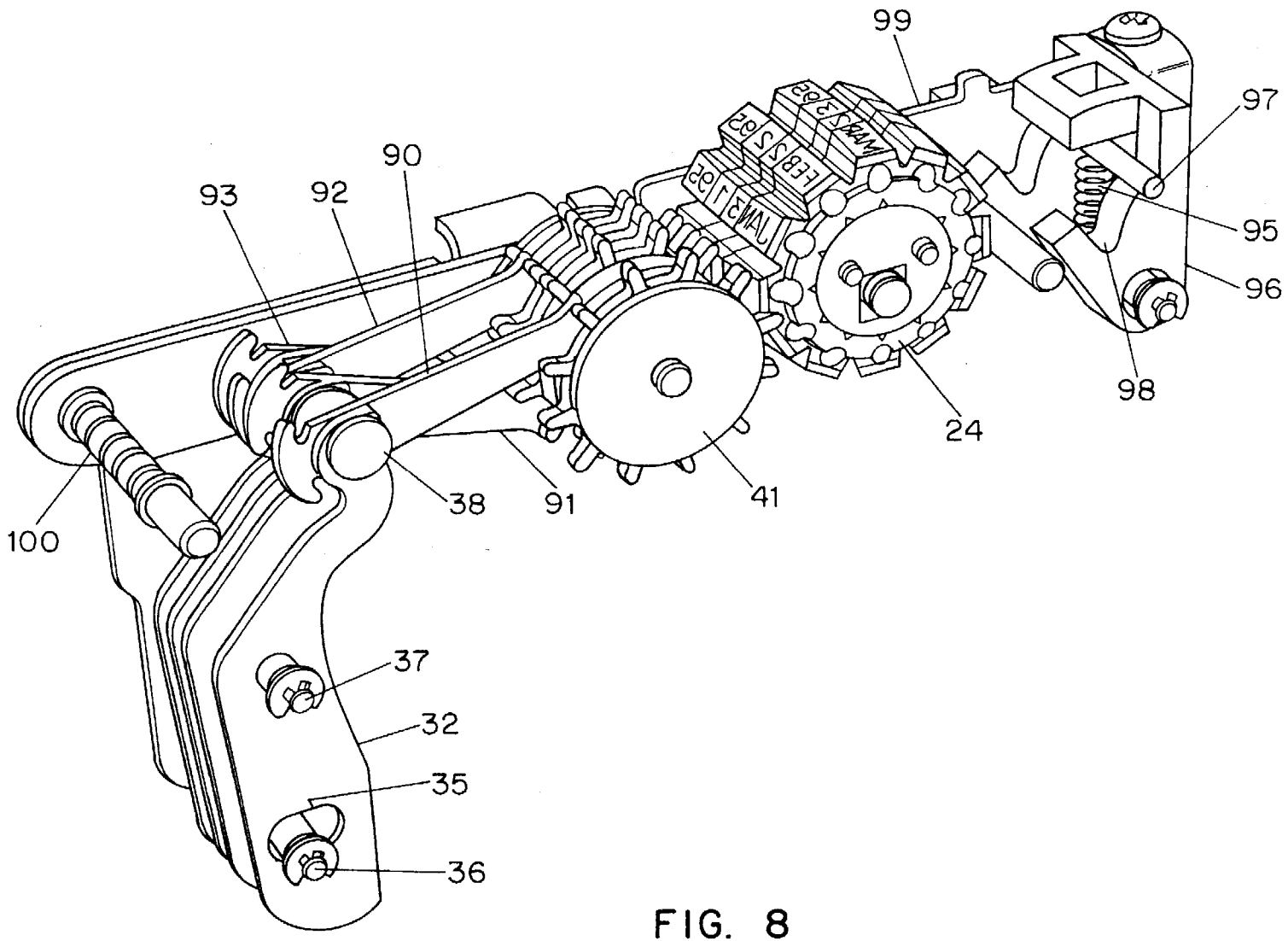
FIG. 8 shows in perspective view a preferred embodiment of the date wheel setting mechanism.

In keeping with the invention, as shown in FIG. 8 it is preferred to set up the pawl members 90, 91, 92, and 93 in an alternating up and down configuration. As shown in FIG. 8, pawl members 90 and 92 are both "up", meaning that each one advances its respective ratchet wheel 41 clockwise in FIG. 8. This advances the respective date wheel 24 counterclockwise. Pawl member 91 and 93 are both "down", meaning that each one advances its respective ratchet wheel 41 counterclockwise in FIG. 8. This advances the respective date wheel 24 clockwise.

In FIG. 8 the date retraction control 96 is shown. With control 96 in the position shown the date wheels 24 are held upwards in FIG. 8, in contact with a mail piece during printing. If the user wishes to retract the date wheels 24 so that they do not print, the user rotates control 96 about one-eighth of a rotation clockwise. Pin 97, previously held up by control 96, now drops down into groove 98, urged downwards by spring 95. As pin 97 is fixed to frame member 99 (which has a front counterpart parallel thereto and omitted for clarity in FIG. 8) then frame member 99 moves downward, pivoted about pivot point 100, lowering the print wheels 24. Desirably, even if frame member 99 rotates downwards in this way, the pawl members 90–93 are still capable of advancing the date wheels 24.

If the user wishes once again to have a printable date, the user rotates control 96 counterclockwise in FIG. 8, lifting pin 97 against spring 95, and lifting the date wheels 24.

Figure 9:
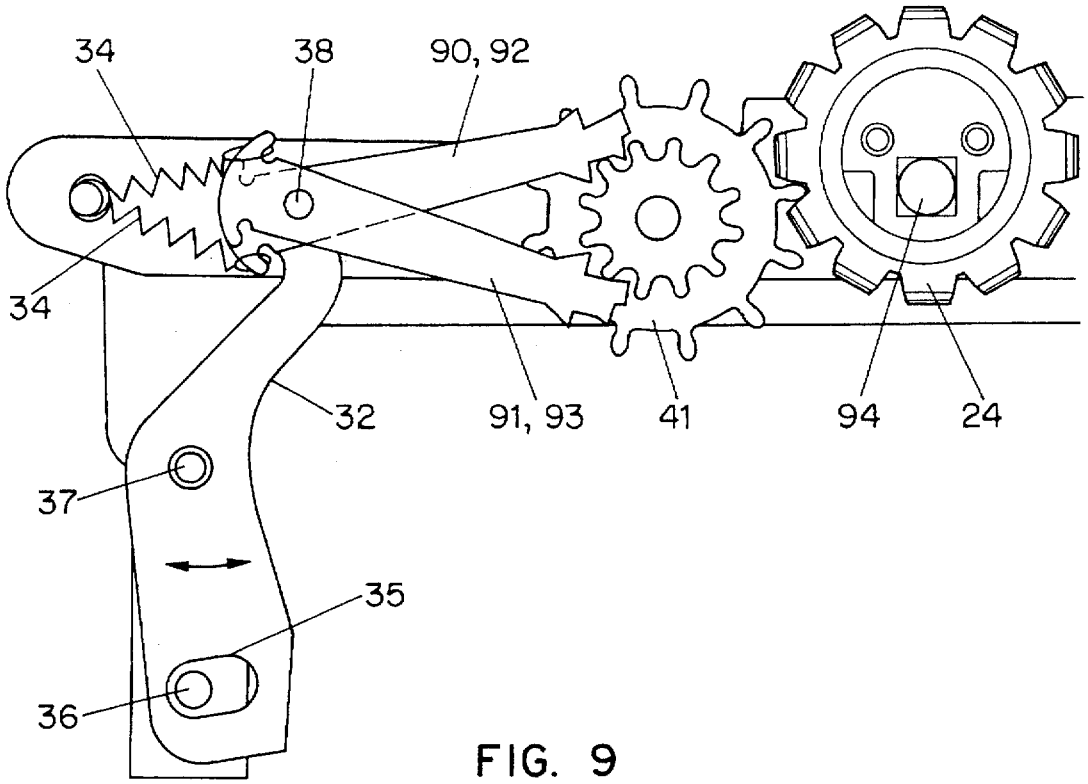
FIG. 9 shows in plan view the preferred mechanism in its relaxed state.

Omitted for clarity in FIG. 8 are the return springs 34 (see FIG. 9).

One skilled in the art will appreciate that it is desirable to lay out the print indicia on the print wheels 24 to match the setting direction. As shown in FIG. 8, the month wheel rotates counterclockwise to advance from, say, January to February. On the wheel itself, February lies just clockwise from January.

The wheel next to the month wheel is the tens digit of the date.

This wheel rotates clockwise to advance the tens digit. On the wheel itself, 3 lies just counterclockwise from 2.

The wheel next in sequence is the ones digit of the date. This wheel rotates counterclockwise to advance the ones digit. On the wheel itself, 3 lies just clockwise from 2.

The wheel next in sequence is the year of the date. This wheel rotates clockwise to advance the date. On the wheel itself, 1995 lies just counterclockwise from 1994.

The sequence of date wheels is, of course, different for example in Europe where the presentation is day, month, and year. In such a configuration the levers 32 may be in different positions along pivot pin 37. This leaves unchanged the basic teaching which is the desirability of advancing adjacent wheels in opposite directions.

It will be appreciated that one distinctive aspect of the structure shown in FIG. 8 is that the date wheels 24 comprise a "stack" or assembly of wheels with the upwards and downwards arrangement of indicia as described above. This may then be described as a date wheel assembly comprising a plurality of wheels, each with raised indicia thereon, the indicia collectively defining a printable date comprising a year, a month, and a date, an axle, the axle disposed within the wheels such that the wheels each are rotatable thereabout, and detent means urging each of the wheels into any of at least ten positions, further characterized in that the raised indicia are arranged on the respective wheels such that on any two adjacent wheels, the indicia increase in opposite directions. As mentioned above, the sequence of wheels may be month, day, and year, for example for the U.S. market, or may be day, month, and year, for example, for certain European markets, or may be year, month, and day if that sequence is specified by a PTT. The number of wheels will typically be four—the units of the day, the tens of the day, the month, and the two-digit year. Such an arrangement provides twelve years of date coverage. Alternatively, the number of wheels may be five, with the year split into a wheel for each digit thereof. In that case, the meter has a "perpetual" year; it is not limited to twelve years of coverage.

Turning now to FIG. 9, what is shown are the pawls 90–93 and their positioning relative to the ratchet wheels 41. Superimposed in this view are the "up" pawls 90 and 92 and the "down" pawls 91, 93. Levers 32 are shown in their "home" position, which is fully counterclockwise in FIG. 9. They are urged in that direction by return springs 34, and the limit of movement is set by hole 35 and pin 36. The springs 34 also serve to urge each pawl 90, 92 downward toward the wheels 41 (by the lower springs 34). The springs 34 also serve to urge each pawl 91, 93 upward toward the wheels 41. The mechanism just described is desirably unaffected by the date wheels being retracted or raised by the user, as described above.

If all four of the levers 32 were rotated as part of a setting operation, all four of the pawls 90–93 would move rightwards in FIG. 9. Of the date wheels 24, two would move clockwise and two would move counterclockwise.

Figure 10:
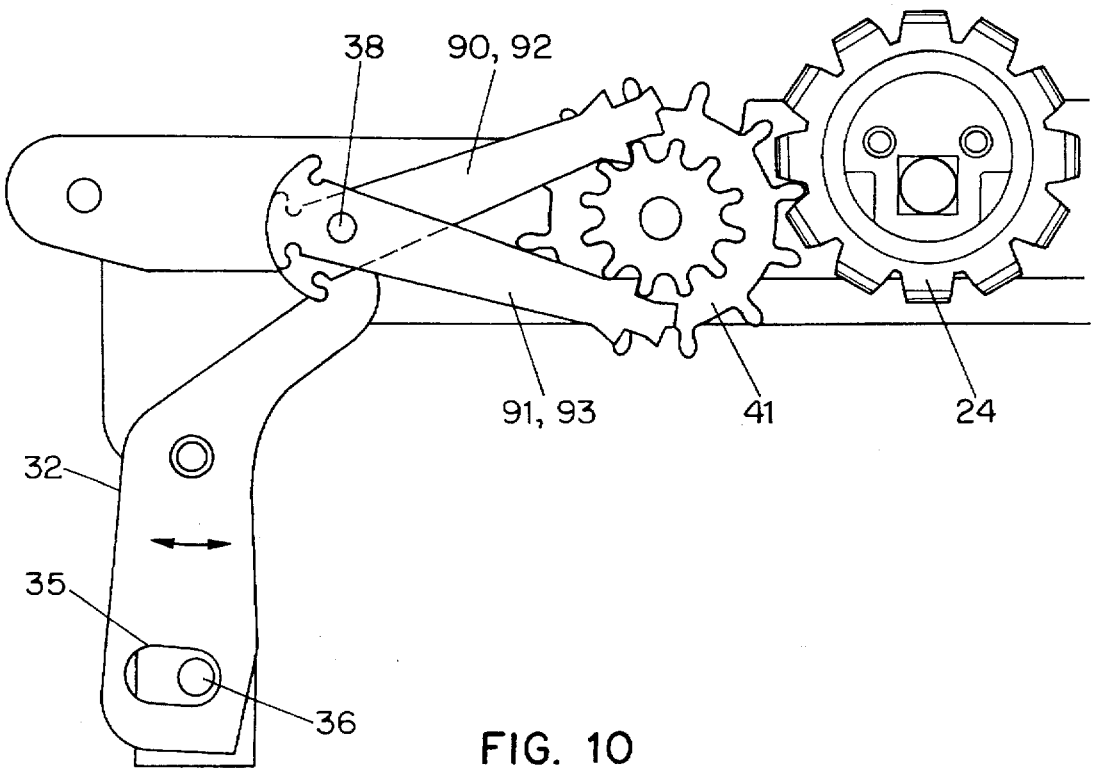
FIG. 10 shows in plan view the preferred mechanism in its actuated state.

FIG. 10 shows the plan view of FIG. 9, but with each of the arms 32 in their actuated (clockwise) position. In this view the springs 34 are omitted for clarity. The extreme movement of each arm 32 is defined by the hole 35 relative to the pin 36. The geometry of the levers 32 and pawls 90–93 is such that each wheel 41 moves about one-twelfth of a rotation. As a result, each of the date wheels 24 moves about one-twelfth of a rotation. The detents, omitted for clarity in FIG. 10, serve to center the print faces of the date wheels 24, and also serve to hold each date wheel 24 in place when the pawls 90–93 subsequently drop back into their rest positions.

It will be appreciated that the configuration shown in FIG. 10, where all four of the levers 32 have been rotated, does not occur very often. Most often if a date needs to be set, only one or two of the wheels 24 needs to change, so only the corresponding levers 32 will be rotated.

It will be appreciated that no matter what position the date wheels 24 may have, any desired new date wheel setting could be accomplished by no more than eleven excursions of various of the levers 32.

It will be appreciated that according to the invention what has been described is, in most general terms, is a postage meter comprising an ascending or descending register within a secure housing, a value printing means operatively coupled with the an ascending or descending register and disposed for printing of postage value, and a plurality of date wheels located on a common axle, each date wheel having indicia thereon indicative of a component of a date. Coupled to at least two adjacent date wheels are respective advancing means. One advancing means advances its respective date wheel upwards and the next advances its date wheel downwards. Nothing about this description relies on any particular design of advancing means, other than that the advancing means advances its wheel in a particular direction and protects its wheel from backward movement. If there are several settable date wheels, it is desirable that each one have a respective advancing means coupled to it, the advancing means disposed to advance their respective date wheels in alternating directions.

It will be appreciated that if the advancing means for the date wheels are disposed one upward, the next downward, and so on, then it is desirable that the print indicia on the wheels be arranged accordingly. Thus, one wheel will preferably have indicia increasing clockwise about the wheel, while the next wheel will preferably have indicia increasing counterclockwise.

Those skilled in the art will appreciate that the teaching of the invention to alternate advancing means clockwise and counterclockwise to overcome wheel dragging applies not only to the particular ratchet mechanism described above, but to myriad other date wheel advancing means. For example one could take any of numerous date wheel advancing means from the prior art, heretofore all applied to rotate date wheels in the same direction, and dispose the advancing means alternately upwards and downwards, thus employing the teaching of the invention to yield a mechanism immune from wheel dragging.

As was mentioned above, in some prior art postage meters the only direction in which the date wheels may be automatically adjusted is in the forward direction. This offers the drawback that if the wheels have been advanced too far forward, it takes a very long time to adjust wheels forward enough that they roll over and approach the correct date from below. But if, on the other hand, the mechanism permits forward and backward adjustment of the date wheels, then there is the danger that a user might take advantage of the forward and backward adjustment capability to print postage that falsely indicates a date of mailing in the past. Such backdating of mail violates postal regulations in some countries, but is easy to do in postage meters that have date wheels that may be manually adjusted by the user.

In the postage meter according to the invention, however, desirably the control program is set up to perform the following method:

the user requests to be able to change the date as indicated by the print wheels;

the user indicates a request, namely the desired date to be indicated on the print wheels;

the control program compares the requested date with the actual calendar date as found in a trusted electronic calendar within the postage meter;

if the requested date is in predetermined relationship with the actual date, then the stored program causes the date wheels to be adjusted to match the requested date;

if the requested date is not in predetermined relationship with the actual date, then the stored program does not change the date wheel position but instead displays an error message to the user;

later, if the user wishes to restore the date to the actual (today's) date, this may be done with the push of just one or two buttons, with no need to enter in all the digits of today's date.

The predetermined relationship is, in compliance with PTT rules, at the very least a requirement that the date can only be set to a date after the present date, not a date in the past. In addition, preferably the stored program is set up so that if a date is set forward, it is set only a limited number of days into the future. The day limit for such setting is a settable parameter, settable by authorized service personnel.

It will be appreciated that this software limitation that dates may only be set forward is quite a different thing than the prior art mechanical limitation of dates only being settable forward. In the prior art meters having the prior art limitation, the automatic mechanism can only advance the date, not change it backwards. Thus it is unworkable from a practical point of view to have the meter change the date forward (for predated mail) and then to have the meter change the date backward (to return to franking of mail with the actual date). In the meter according to the invention, however, the mechanism can equally well change the date forwards or backwards, and it is only a matter of the stored program that the user cannot select dates in the past for franking, but may only select the present date or a limited range of dates in the future.

Those skilled in the art will appreciate that the system according to the invention is closed loop in the sense that the user is able to close the loop by, for example, typing in the present date wheel setting at the keyboard. In response, the control program makes whatever wheel movements as are required to move the wheels to the desired position. It is hoped, however, that in most circumstances the wheels would not be in positions other than the positions that the control program thinks they are in. But it is easy to imagine a circumstance in which it is impossible for the control program to be sure where the wheels are. For example, assume that the setting mechanism being used is the one in which racks are moved forward and back to set value wheels, and in which the manner in which the date wheels are adjusted is by permitting the racks to "over-travel", thereby striking levers that advance the date wheels. In such a system there will preferably be sensors that indicate whether the racks are forward or backward. For example, a setting axle may be rotated forward and back to set the value wheels, and the setting axle is coupled with breakaway clutches to gears associated with each of the racks. The gears are halted at selected positions by the dropping of pawls into sawtooth teeth on the gears; the pawls are dropped by releasing electromagnets. The axle has two sensors on it, one that represents a "home" position for the axle and a second sensor that generates clock pulses indicative of movement of the axle through ten or more angular positions as it moves forward and back. The sensors may be called the "setting axle home" sensor and the "setting axle clock" sensor, and may be seen in FIGS. 9C and 13 as sensors 504 and 503, respectively, in the copending application Ser. No. 08/422,155, entitled "Single-motor setting and printing postage meter" filed Apr. 14, 1995.

As will be seen from FIG. 13 in that application, in the setting axle home position, signal 504 is high and signal 503 is low. When the setting axle is in its extreme position, signal 504 is again high, and signal 503 is high. In this way software may distinguish between the axle being in its home or extreme positions.

In the normal case, when power is applied to the meter the axle is in its axle home position. Sensor 504 is high and sensor 503 is low. It may be reasonable assumed in software that the date wheels are intact—that they are in the position that they were in before power was lost.

Consider now the case where, upon application of power, the sensor 504 is low. Basically this means that the setting axle is in the middle of the first half of a setting cycle or in the middle of the second half of a setting cycle. Software cannot be sure whether the axle is in the first half of the setting cycle or the second half of the setting cycle. Thus the best course of action is to turn off power to the pawl electromagnets so that the pawls drop into the sawtooth teeth of the setting wheels, and to energize the setting motor until such time as signals 503 and 504 are both high. This means that the setting axle has reached its half-way position. Then the software proceeds as described next for the situation where both signals 503 and 504 are high.

In the case where upon power-up the signals 503 and 504 are both high, it is assumed that the setting axle is in its extreme position (half way through a setting cycle, point 502 in FIG. 13 of copending application Ser. No. 08/422,155. In this instance, the electromagnets are energized and the setting motor is turned on. In software, a count is kept of the number of pulses received from sensor 503. If it exceeds some predetermined number (e.g. 15) without the signal 504 going high, then under software control the magnets are de-energized and the pawls drop onto their respective sawtooth setting wheels. It is assumed in software that this means the value wheel setting is not known to be good, but the date wheels will be unaffected by the actuation of the setting motor.

In this way the software can recover from the circumstance of power being applied when the setting cycle was in progress, and software is able to know whether or not the date wheel positions have been corrupted, and is able to know whether or not the value wheel positions are known with confidence.

It should be appreciated that those skilled in the art may readily devise obvious modifications and variations from the precise embodiments described herein, all of which are within the scope of the invention, which is defined by the claims which follow.

We claim:

1. A date-setting method for use in a postage meter having date wheels, the method comprising the steps of:

setting the date wheels;

printing on a mail piece whereby a date is printed on the mail piece by the date wheels;

requesting an input indicating whether the date printed on the mail piece is correct;

receiving a response in the negative;

receiving information indicative of the date printed on the mail piece;

resetting the date wheels;

logging a record indicative of the negative response and the resetting action;

printing on a mail piece whereby a date is printed on the mail piece by the date wheels;

requesting an input indicating whether the date printed on the mail piece is correct;

receiving a response in the negative;

receiving information indicative of the date printed on the mail piece;

resetting the date wheels;

logging another record indicative of the negative response and the resetting action; and annunciating the records indicative of negative responses.

2. The method of claim 1 wherein the annunciating step further comprises annunciating the event of records indicating backdating of the meter.

3. The method of claim 1 wherein the annunciating step further comprises communicating the ratio of the number of negative responses to the number of date wheel settings.

4. A date-setting method for use in a postage meter having date wheels capable of printing a date on a mail piece, the method comprising the steps of:

setting at least one date wheel;

waiting until after the first time that postage has been printed on a mail piece subsequent to the setting of a date wheel; and thereafter, requesting an input indicating whether the date printed on the mail piece is correct.

* * * * *